US009863274B2

(12) United States Patent
Chilton et al.

(10) Patent No.: US 9,863,274 B2
(45) Date of Patent: Jan. 9, 2018

(54) COLLAPSIBLE SUPPORT STRUCTURE FOR A GAS TURBINE ENGINE

(71) Applicant: ROLLS-ROYCE PLC, London (GB)

(72) Inventors: Nicholas Edward Chilton, Derby (GB); Michael John Barker, Nottingham (GB)

(73) Assignee: ROLLS-ROYCE plc, London (GB)

( * ) Notice: Subject to any disclaimer, the term of this patent is extended or adjusted under 35 U.S.C. 154(b) by 317 days.

(21) Appl. No.: 14/881,471

(22) Filed: Oct. 13, 2015

(65) Prior Publication Data

US 2016/0130975 A1 May 12, 2016

(30) Foreign Application Priority Data

Nov. 7, 2014 (GB) ..... 1419859.2

(51) Int. Cl.

| | |
|---|---|
| ***F01D 21/04*** | (2006.01) |
| ***F01D 25/16*** | (2006.01) |
| ***F01D 21/08*** | (2006.01) |
| ***F01D 25/24*** | (2006.01) |

(52) U.S. Cl.

CPC ..... *F01D 25/162* (2013.01); *F01D 21/045* (2013.01); *F01D 21/08* (2013.01); *F01D 25/24* (2013.01); *F05D 2220/32* (2013.01); *F05D 2240/50* (2013.01); *F05D 2240/60* (2013.01); *F05D 2260/311* (2013.01)

(58) Field of Classification Search

CPC ..... F01D 21/08; F01D 21/045; F01D 25/162; F01D 25/24

USPC ..... 415/9

See application file for complete search history.

(56) References Cited

U.S. PATENT DOCUMENTS

| | | | | |
|---|---|---|---|---|
| 4,201,513 A * | 5/1980 | Sales | F01D 21/045 415/9 |
| 6,073,439 A | 6/2000 | Beaven et al. | |
| 6,079,200 A * | 6/2000 | Tubbs | F01D 21/045 415/9 |

(Continued)

FOREIGN PATENT DOCUMENTS

| | | |
|---|---|---|
| GB | 2323637 A | 9/1998 |
| GB | 2444935 A | 6/2008 |
| GB | 2461778 A | 1/2010 |

OTHER PUBLICATIONS

Apr. 20, 2015 Search Report issued in British Application No. 1419859.2.

(Continued)

*Primary Examiner* — Woody Lee, Jr.
(74) *Attorney, Agent, or Firm* — Oliff PLC

(57) ABSTRACT

Described is a shaft support system for a gas turbine engine comprising: a rotatable fan shaft; first and second support structures extending in parallel from the shaft to a load bearing structure to provide radial location of the shaft within an engine casing, wherein the first support and second support structures include first and second respective mechanical fusible joints; wherein the first fusible joint is a two-stage fuse which partially fails within a first predetermined load range, the second fusible joint fails within a second predetermined load range which is different to the first load range, and the first fusible joint fully fails only when the second fusible joint has failed.

20 Claims, 2 Drawing Sheets

(56) References Cited

U.S. PATENT DOCUMENTS

| | | | | |
|---|---|---|---|---|
| 8,939,705 | B1 * | 1/2015 | Lee | F01D 11/122 415/1 |
| 2004/0240985 | A1 * | 12/2004 | Stephenson | F01D 21/045 415/9 |
| 2006/0269391 | A1 | 11/2006 | Stephenson et al. | |
| 2007/0253804 | A1 * | 11/2007 | Heyerman | F01D 9/026 415/9 |
| 2013/0272871 | A1 | 10/2013 | Webster et al. | |
| 2014/0314546 | A1 * | 10/2014 | Davis | F01D 21/045 415/124.1 |
| 2016/0230587 | A1 * | 8/2016 | Watts, III | F01D 19/00 |
| 2017/0175753 | A1 * | 6/2017 | Tan-Kim | F04D 29/054 |

OTHER PUBLICATIONS

Mar. 3, 2016 Search Report issued in European Patent Application No. 15189458.

* cited by examiner

COLLAPSIBLE SUPPORT STRUCTURE FOR A GAS TURBINE ENGINE

TECHNICAL FIELD OF INVENTION

The present invention relates to a collapsible support structure for a gas turbine engine. In particular, though not exclusively, the support structure constitutes part of the bearing chamber of the gas turbine engine which is configured to collapse to accommodate the relocation of a shaft during an extreme event.

BACKGROUND OF INVENTION

FIG. 1 shows a ducted fan gas turbine engine 10 comprising in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle 32 generally surrounds the engine 10 and defines the intake 12, a bypass duct 34 and a bypass exhaust nozzle 36. The engine has a principal axis of rotation 31.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by concentric interconnecting shafts 38, 40, 42.

Gas turbine engines must be able to withstand several failure modes before being certified for use on commercial airlines. One of these failure modes is an extreme event known as a fan blade off in which a blade of the fan is released in operational service.

As will be appreciated, when a fan blade detaches there is a high energy impact on the fan casing as the blade moves outwards. Also, the fan assembly becomes significantly unbalanced due to the loss of the fan blade and the new asymmetrical loading around the fan's axis of rotation. The imbalance can create large orbiting radial forces which need to be accommodated to prevent the engine breaking up, particularly at high rotational speeds.

The present invention seeks to provide a support structure which collapses in a specific and predetermined way such that the radial loads of the fan can be redistributed and the fan allowed to orbit about a new centre of mass.

STATEMENTS OF INVENTION

The present invention provides a shaft support system according to the appended claims.

Thus there is a shaft support system for a gas turbine engine comprising: a rotatable fan shaft; first and second support structures extending in parallel from the shaft to a load bearing structure to provide radial location of the shaft within an engine casing, wherein the first support and second support structures include first and second respective mechanical fusible joints; wherein the first fusible joint is a two-stage fuse which partially fails within a first predetermined load range, the second fusible joint fails within a second predetermined load range which is different to the first load range, and the first fusible joint fully fails only when the second fusible joint has failed.

The first support structure may be a bearing chamber wall, and the second support structure is a bearing arrangement within a bearing chamber defined by the bearing chamber wall.

The first fusible joint may fully fail under a third predetermined load range which is less than the second predetermined load range. The first fusible joint may include a slip joint and wherein the first load range causes the slip joint to slip.

The first support structure may include first and second members compressibly connected by the slip joint.

The slip joint includes a fastener to provide the compressible connection, and the fastener passes through an aperture in the first member for attachment to the second member, the aperture being over-sized in relation to the fastener such that the fastener will move within the aperture when a load threshold within the first predetermined load range is exceeded.

The bearing arrangement may be connected to the shaft, and the second fusible joint is located between the bearing arrangement and the shaft.

The second fusible joint may include a male and female connection having a male part mateably received within a female part.

The female part may include an annular recess in an end surface thereof, the recess being provided by a lip on the radial outer surface of the annular recess, the annular recess receiving and radially restricting the movement of the male part.

A catcher ring may additionally be provided which is axially spaced aft of the bearing arrangement, wherein the lip extends axially and the axial extent of the lip may be shorter than the separation between a catcher ring and bearing arrangement.

The bearing chamber wall may extend in a radial and axial direction with the first fusible joint being provided along the length of the bearing chamber wall to define radially inner and outer bearing chamber walls which radially overlap when the first fusable link severs.

The shaft and the radially inner surface of the inner race and the shaft are separated by a radial gap when the shaft is rotatably held on the principal axis of rotation, and wherein once the first and second fusible joints have severed, the shaft orbits within the gap and around the principal axis of rotation on the radially inner surface of the inner race.

The clearance of the aperture in the first fused connection is between 1.2 to 2 times the width of a bolt which holds the first fused connection together.

The first load range may be between 20 and 90 kN. The second load range may be between 800 kN and 1.2 MN. The third predetermined range may be between 300 kN and 500 kN.

The invention may be implemented on a gas turbine engine.

The load bearing structure may be the engine casing. The bearing arrangement may include a ball bearing arrangement having an inner race and an outer race. The bearing chamber wall may include a seal arrangement. The seal arrangement may be a contacting seal and or a compliant seal. The contacting seal may be a carbon seal.

The slippage in the slip joint may be restricted to a predetermined amount. The predetermined amount may be sufficient to cause the load to be predominantly carried by the second support structure. The second load range may be sufficient to cause the first fusible joint to sever when the second fusible joint has severed and the first fuse joint is reloaded.

The fasteners may be bolts. The bolts may be received within threaded portions of the other of the first and second members. Alternatively, the fasteners may be threaded studs and nuts. The fasteners may be supplemented with pins which extend from one of the first or second members. The pins may be mateably received by the other of the first and second members. The severance of the fasteners may determine the severance of the first fusible joint.

The female and male parts may be additionally connected via one or more fasteners. The fasteners may be bolts. The fasteners maintain the axial relation of the male and female parts in normal use. The fasteners may also aid the radial restriction of the male part. The shaft may include a stub shaft. The stub shaft may be a short ancillary shaft which connects to and surrounds the shaft. The stub shaft may pass axially between the shaft and the bearing arrangement. Either of the male or female part may be provided by the stub shaft. The male or female part may be provided at a terminal end of a portion of the stub shaft. The portion may be a flange. The bearing arrangement may include an inner race sleeve which is attached to the inner race and which provides the other of the male or female part at an axial end thereof.

The bearing chamber wall may be an upstream bearing chamber wall. The upstream bearing wall may be proximate the fan. The downstream wall of the bearing chamber may not include a fusible joint.

The bearing chamber walls may be segmented. The segments may be provided by the radially inner and outer bearing chamber walls. Further segments may be defined by a seal.

The radially inner and outer bearing chamber walls may be provided by panels. The panels may be frusto-conical. The trajectory of panels may be substantially similar. The panels may be offset by a stepped portion. The stepped portion may include the first fusible joint.

When the gap is closed, the radially inner and outer bearing chamber walls overlap.

DESCRIPTION OF DRAWINGS

Embodiments of the invention will now be described with the aid of the following drawings of which.

DETAILED DESCRIPTION OF INVENTION

Figure 1:
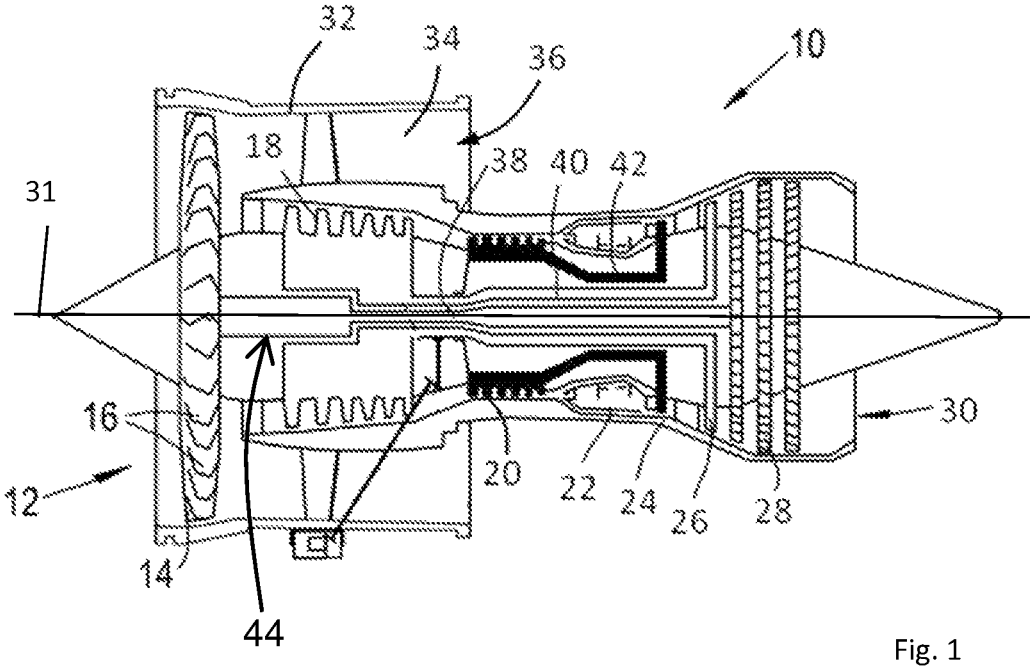
FIG. 1 shows a longitudinal cross-section of a conventional gas turbine engine.
Figure 2:
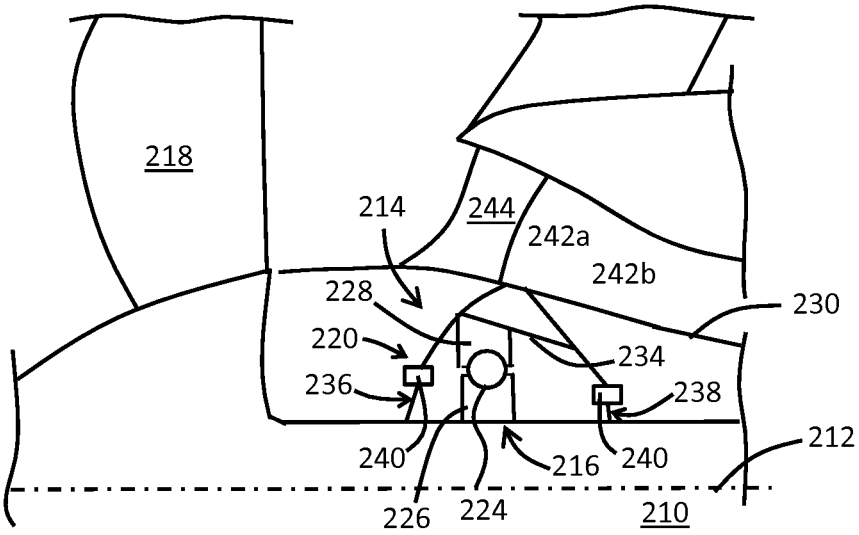
FIG. 2 shows a schematic partial cross-section of a front bearing chamber support structure.

FIG. 2 shows a schematic partial longitudinal section of a gas turbine engine having a shaft support system 214 in which a shaft 210 is rotatably retained on the central or principal axis of rotation 212 of the engine.

The shaft is principally retained on the central axis of the engine in normal use by a bearing arrangement 216 which provide axial and radial restraint of the shaft and fan assembly. However, in during an extreme event, the shaft support system is loaded to a point where the shaft support system 214 includes a first support structure in the form of a bearing chamber wall 236, and a second support structure in the form of a bearing arrangement 216. The bearing chamber wall 236 and bearing arrangement 216 extend in parallel (as opposed to being serially connected) from the shaft 210 to a load bearing structure in the form of the engine casing 230. The first and second support structures provide radial and axial location of the shaft 210 within the engine casing 230.

The first and second support structures include first and second respective mechanical fusible joints which allow the bearing chamber wall 236 and bearing arrangement 216 to collapse in a predetermined way, thereby reconfiguring the support for the shaft 210 and allowing it to move radially outwards into a new, orbiting rotational path.

The first fusible joint incorporates a two-stage fuse which partially fails under a first predetermined load range. In doing so, the first of the parallel load paths is largely disengaged such that load is redistributed to the second support structure and the second fusible joint. The second fusible joint is configured to fail within a second predetermined load range, which is different to the first load range.

Once the second fusible connection has failed, load path moves largely back to the first support structure and thus through the first, partially failed, fusible joint. Once reloaded, the first fusible joint shears so as to fully fail. In doing so, the radial support through the fusible joints is removed, and the fan shaft 210 is able to move radially outwards.

After a given displacement, the fan shaft will contact the bore of the IP spool (not shown). This will restrain the movement of the fan and in so doing react the residual load from the damaged fan set. To limit the load transferred through this connection a joint within the load path is designed to be fusible. If the residual load exceeds the fuse strength the joint will fail removing the radial constraint and allowing the fan to move to a greater radial orbit.

This approach is applied to the sequence of radial constraints until the fan shaft achieves the required orbit or the residual load is below the fuse strength and within the capability of the engine structure. Thus, it will be appreciated that similar fused joints may be provided in other areas of the engine to allow the shaft to have a greater degree of movement which may be required for some engines.

The shaft 210 of the described embodiment is the low pressure shaft and thus attached to and drives the fan 218 of the gas turbine engine to provide propulsive thrust, as described above. The shaft 210 runs through the engine along the central axis and is connected to the low pressure turbine towards the rear of the engine.

The bearing arrangement 216 is enclosed within a bearing chamber 220 which provides an enclosed area for oil circulation to keep the bearing arrangement 216 lubricated in use. The bearing of the described embodiment is a ball bearing which includes an annular array of rotating spherical elements 224 held between radially inner 226 and outer 228 races as is known in the art.

As described in more detail below, the bearing arrangement 216 and bearing chamber 220 are arranged to collapse in a predetermined and predictable way during an extreme event such as a fan blade off in which a blade of the fan 218 becomes detached from the rotating fan hub in use. The detachment of the fan blade results in the fan 218 becoming unbalanced with a new centre of mass having an off-centre orbiting rotational path. The collapsible supporting structure allows for the new natural orbiting rotational path of the unbalanced fan shaft 210 to be more readily accommodated. The collapsible nature of the support structure is provided by a plurality of fused joints which are designed to collapse over separate ranges of radial loading. This allows the progressive collapse of the support structure which helps dissipate the impacting energy of the unbalanced fan 218.

The bearing arrangement 216 provides axial and radial restraint of the shaft 210 in normal operational use. The outer race 228 of the bearing is held in a stationary relation to the engine core casing 230 so as to not rotate. The inner race 226 is attached to the shaft 210 and as such rotates relative to the outer race 228 and engine casing 230. It will be appreciated that other bearing arrangements are provided along the length of the shaft 210 so that the shaft 210 can be held on the central axis of rotation 212 along its length. It will also be appreciated that the invention may be applicable to other types of bearing arrangements rather than the ball bearing arrangement of the described embodiment.

The bearing chamber 220 is defined by bearing chamber walls. These walls include a lateral wall 234 of an annular construction which extends in a predominantly axial direction and radially outboard of the bearing inner race 226. The lateral wall traverses between and sealably connects to fore 236 and aft 238 segmented bearing chamber walls which axially are spaced on either side the bearing arrangement and extend from the shaft 210. The fore 236 and aft 238 walls extend in a radial and axially opposing directions so as to be generally convergent in their relative orientation.

It will be appreciated that the specific angles and dimensions of the walls will be particular to the application and the operational requirements for a given engine architecture and as such not elaborated upon further here.

Each of the fore 236 and aft 238 walls include a sealing arrangement 240 which breaks the segmented bearing chamber walls into rotatable and stationary portions relative to the engine casing 230. This allows the shaft 210 and a portion of the bearing chamber walls to rotate within the engine casing 230 whilst the oil is maintained within the bearing chamber 220. In the described embodiment, the seals 240 are contacting carbon seals, but it will be appreciated that other seals such as labyrinth or brush seals may be used in some instances.

The outer race 228 is supported and attached to the engine casing 230 by a support structure which includes three annular walls 234, 242*a*, 242*b* arranged in a triangular configuration when viewed in section as shown in FIG. 2. These walls transmit the radial and axial loads of the bearing arrangement 216, and thus shaft 210, to the engine casing 230. The lateral wall 234 of bearing chamber 220 provides the radially inner or base of the triangular wall arrangement and the mounting for the outer race 228. The two other walls extend from or local to the ends of the lateral wall 234 and meet in a relatively close relation on the engine casing 230, radially inwards of and local to the core flow nozzle guide vane 244. In section as viewed in FIG. 2, the walls of the bearing chamber 220 and the supporting walls of the outer race 228 together form an A frame and act in concert to carry the axial and radial loads of the fan shaft 210 to the inner annulus of the core gas path or core casing 230.

Figure 3:
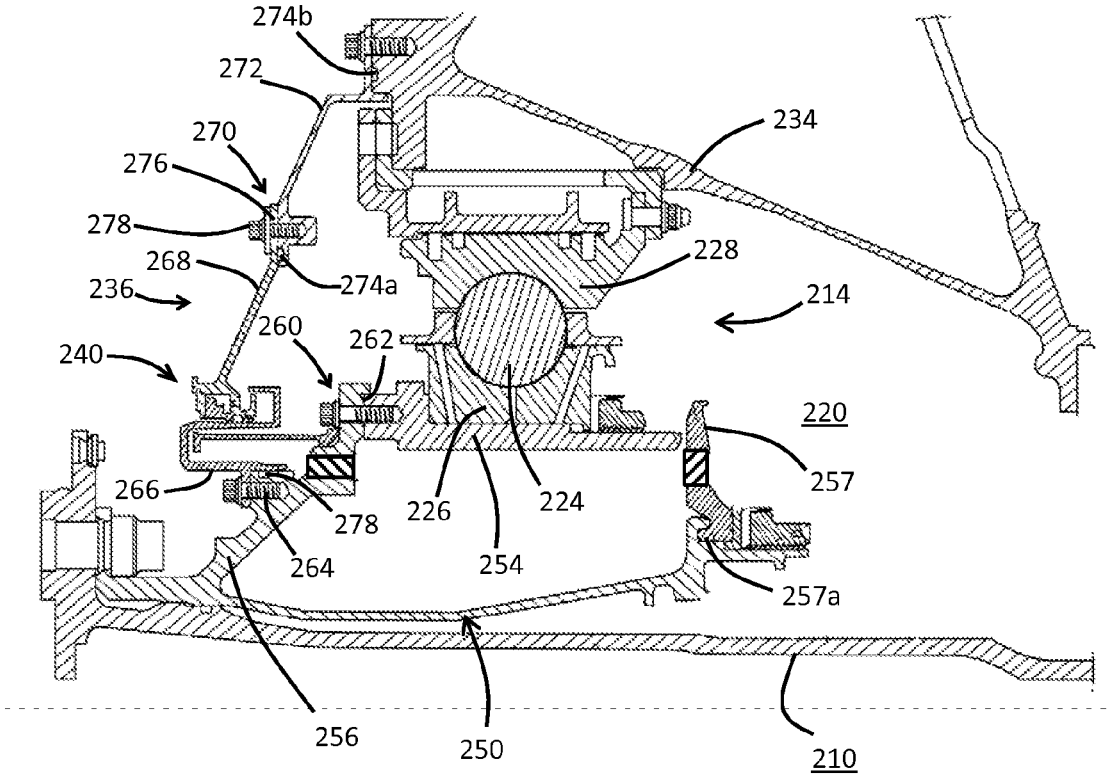
FIG. 3 shows a detailed longitudinal cross-section of the front bearing chamber having fusible joints.

Turning to FIG. 3, there is shown a section of a portion of the bearing chamber 220 in more detail. Hence, there is shown the bearing 224 having the inner 226 and outer 228 race and a bearing cage 246. The outer race 228 is held in a stationary relation to the engine casing 230 by a mounting assembly 248 which is attached to the lateral wall 234 of the bearing chamber 220. The mounting arrangement 248 includes a double walled structure which mates to the lateral wall 234 at an upstream end via a flanged union, but it will be appreciated that this may vary according to the application.

The inner race 226 attaches to the low pressure shaft 210 via a mounting arrangement in the form of a cylindrical sleeve 254, which carries the inner race 226 on its radially outer surface, and a stub shaft 250. The stub shaft 250 is a relatively short shaft which sits coaxially around the low pressure shaft 210 and extends axially between the cylindrical sleeve 254 and the low pressure shaft 210.

The upstream end of the stub shaft 250 includes a conical flange 256 which extends from an attachment portion 258 which is fixedly attached to the low pressure shaft 210 via a bolted flange 256. The conical flange 256 projects radially outwards and downstream at an angle of around 40 degrees relative to the central axis of the engine.

A mounting point in the form of a second fusible joint 260 is provided by an axially facing recessed annular surface 262 at the free end of the flange 256 for abutment with and attachment of the cylindrical sleeve 254. This fused connection 260 is designed to fail during a fan blade off event as described in more detail below.

A further mounting formation 264 is provided along the length of the upstream stub shaft flange 256 on the radially outboard surface. This second mounting provides an attachment for the rotating part of the upstream bearing chamber wall 236 which will be described in more detail below.

The downstream end of the stub shaft 250 includes a catcher ring 257 which is axially separated from the inner race structure so as to rotate in isolation in normal operation. During a fan blade off event however, the low pressure shaft moves axially forward and forces the catcher ring into cylindrical sleeve 254 so as to restrict the forward axial movement and prevent the fan driving forwards out of the fan blade containment system.

The fore or upstream bearing chamber wall 236 is made from a plurality of segments. The first segment 266 extends from the stub shaft 250 and provides a rotating radially facing platform against which the sealing element 240 contacts to provide a seal. The stationary part of the seal 240 is carried by the second segment 268 of the bearing chamber wall 236 which is connected, indirectly, to the engine casing 230 and is consequently non-rotating.

The second segment 268 of the bearing chamber wall 236 is in the form of a frusto-conical panel which extends from the seal arrangement 240 in a radially outwardly and downstream direction to a bearing chamber wall fused joint 270.

The third segment 272 extends from the bearing chamber fusible joint 270 towards the lateral wall 234 with a similar trajectory as the second segment 268 of the bearing chamber wall 236. The third segment 272 is attached to the outer race support structure via a bolted flange located at the junction of the lateral wall 234 and wall 242*a*. The second and third segments 268, 272 of the bearing chamber wall 236 have a similar trajectory such that they form a generally conical panel in unison with an axially facing step at which the fusible joint 270 between two segments is located. The length of the respective second and third segment panels is broadly similar such that the fusible joint 270 is located at around the radial and axial mid-point between the seal 240 and joint with the support wall.

The assembly of the bearing chamber wall 236 provides a suitable boundary wall to segregate the oil chamber from the surrounding air system. This is completed by the seal 240, and compression seals 274*a,b* in the form of o-rings at each of the joints, although other seals are contemplated.

The bearing chamber wall 236 is constructed of suitable materials and dimensions such that it can accommodate a portion of the radial load from the low pressure shaft 210 during an extreme event. However, it will be appreciated that the majority of the load is transferred through the bearing arrangement 216 to the engine casing 230. The split of the load and relative dimensions will dependent on many engine specific factors which will be determinable by the skilled person for a particular application.

The downstream wall has a similar segmented construction as the upstream wall with the exception that it does not include a fusible joint.

Thus, there are two fused connections 260, 270 in the parallel load paths which connect the low pressure shaft 210 to the engine casing 230. In the described embodiment, the first fused connection 270 is in the bearing chamber wall 236 and the second is located between the shaft 210 and the bearing arrangement 216, specifically between the stub shaft 250 and inner race 226. Further, in the described embodiment, the bearing chamber wall 236 is arranged to fail in a two-stage process in which there is a partial break-down or fusing at a first, lower range of radial loading, prior to a complete failing a second, higher and distinct, radial loading.

The first fusible joint 270 is provided by a slip joint in which confronting faces of the two mated components are compressibly clamped together to provide a frictional engagement. The frictional engagement is such that the two components stay in a fixed relation under normal operating conditions and fail only when a predetermined load threshold is exceeded. As will be appreciated, the load threshold lies within a predetermined range of load which is associated with the radial loads experienced under an extreme event such as a fan blade off. Thus, the predetermined range is calculated from the known properties of the mating of the confronting faces under a particular clamping load, and the radial forces expected in a fan blade off event.

When activated, the slip joint allows the relative radial movement of the two associated panels up to a predetermined amount when loaded within a first load range. When the load increases, it reaches a point where the permissible slip is exhausted and the joint shears. The slip joint 270 is located between the second 268 and third 272 segments of the bearing chamber wall 236.

The clamping force of the joint is provided by a bolted interface in which the first segment includes a plurality of circumferentially distributed bolt receiving apertures 276 through which a bolts 278 pass. The third bearing chamber wall segment 272 includes a corresponding plurality of circumferentially distributed threaded portions for receiving the bolts 278. It will be appreciated that the number and relative angular position of the bolts 278 will vary according to the specific architecture of the engine but there may typically be around twenty or thirty evenly distributed around the interface between the two segments. It will also be appreciated that other compressible joints are envisaged to provide the frictional engagement between the confronting faces. For example, the arrangement may be provided with a stud and nut fastener.

To enable the connection to act as a fuse, the bolt receiving aperture 276 is over-sized relative to the bolt shank which is later received. The extent of the over-size is sufficient to allow a predetermined amount relative movement between the first and second segments of the walls when a load threshold is achieved. The amount of movement between the two segments is enough to allow the load path to be transferred to the bearing and second fusible link 260. The size of the aperture 276 may be between 1.2 to 2 times the width of the bolt shank. In one example, the bolt 278 is 5 mm with the hole being 8 mm.

To ensure that the joint slips in the required manner, the bolts 278 are torqued by a predetermined amount during assembly. The amount of torque may be calculated using methods well known in the art. Such methods consider the contacting area of at the interface of the two panels and a determination of the frictional engagement therebetween. Thus, in use, the bearing chamber wall fuse 270 partially fails by overcoming the frictional engagement between the mating interfaces of the bearing chamber wall segments so as to slip relative to one another and limit the load carrying capacity of the wall. The second stage failure of the first fused joint 270 occurs when the shaft 210 moves enough to overcome the slippage range provided by the oversized hole 276 and loads the bolt 278 until breaking point.

In addition to the bolted union in the slip joint, the first fused connection includes a plurality of pins arranged around the circumferential interface to provide radial and circumferential location. The pins are fewer in number than the bolts. In the described embodiment, there are just three but more could be used if desired.

The stub shaft fused connection 260 is provided by a bolted union between the stub shaft 250 and the cylindrical sleeve 254 which supports the inner race 226. The stub shaft 250 includes a frusto-conical flange 256 which terminates in a free end having an axially facing annular surface. This axially facing surface provides the mating interface for a corresponding surface of the inner race 226 supporting structure. The free end of the stub shaft flange 256 further includes an axially extending lip which projects from radial extreme of the flange 256 so as to provide a cap like profile in which a recess is provided by the lip. The terminal end of the inner race cylindrical support sleeve is sized so as to be snugly received within the lipped recess of the stub shaft flange 256.

The cylindrical sleeve sits radially inwards of the inner race 226 and provides an upstream facing axial face at the upstream terminal end thereof. The outer circumferential surface of the terminal end is sized to be snugly received within the interfacing recess lip provided by the stub shaft flange 256. Thus, the engagement between the stub shaft 250 and inner race support sleeve is radially restrained by the overlap of the lip with the outer surface of the sleeve.

The axial retention of the two components is provided by a plurality of bolts which are evenly distributed around the circumference of the joint. The bolts pass through a suitable aperture in the stub shaft flange 256 and are threadingly engaged within the terminal end of the sleeve.

It is to be noted that the axial extent of the lip is relatively short to enable disengagement for the lip from the sleeve during fan blade off as described below. The axial length of the lip is sized to ensure that it disengages from the cylindrical sleeve 254, allowing radial release of the rotor during an extreme event. The axial displacements are controlled by the clearance and the compliance of the catcher ring 256. Axial displacements need to be minimised to ensure the inter-shaft roller bearing remains engaged. It is to be noted that the catcher ring 257 includes a deformable joint 257*a* which deflects to accommodate some axial movement and to allow the fusible joint to become detached.

In use, the low pressure shaft 210 and stub shaft 250 are held on the central and principal axis of rotation 212 in the engine. In the event of a fan blade off incident and the unbalancing of the fan, the low pressure shaft 210 and stub shaft 250 undergo a sudden radial loading away from the lost fan blade. Thus, with reference to FIG. 3, if a fan blade was lost at the bottom centre of the engine, the fan shaft would move upwards such that the first and second load paths and fusible joints in the bearing chamber wall 236 bearing arrangement 216 become asymmetrically loaded around the engine.

The load increases until a first load threshold is achieved within the predetermined range and the frictional engagement across the bolted interface is overcome to allow the joint to slip. This causes the increasing radial load to be distributed predominantly through the bearing arrangement 216 and stub shaft fused connection 270.

Due to the radial movement of the shaft 210 and the associated moment, the bolts on the opposite side of the engine to the outboard radial movement are put under a tensile load with tries to pull the inner race sleeve and stub shaft flange 256 apart.

When a second radial load threshold, within the second predetermined load range is reached, some of the bolts which axially retain the stub shaft 250 and inner race sleeve together elongate such that the stub shaft 250 and inner race 226 begin to axially separate. The axial separation continues to a point in which the sleeve is no longer retained by the lip and the sleeve escapes the lip and recess. Once released, the remaining bolts fail under shear until the two components are axially and radially separated with respect to the recess in the stub shaft flange 256.

Once separated, the shaft 210 is free to move in a radial direction once more and the load path is redistributed to the bearing chamber wall 236 to exhaust the slip range which is afforded by the over-sized hole 276. The second stage failure of the bearing chamber wall 236 is achieved with the shearing of the bolts 278. Once this occurs, the first and second bearing chamber wall segments radially pass one another as the shaft 210 and stub shaft 250 move radially towards the inner race support until contact is made.

The radial offset between the inner race support structure and the stub shaft 250 is sufficient to accommodate the off-centre orbital path of the unbalanced fan shaft. Thus, when collapsed, the structure allows the shaft 210 to orbit around the bearing chamber 220, thus accommodating the new centre of mass of the fan.

The collapse of the support structure system needs to account for the new orbiting path of the unbalanced fan assembly. As will be appreciated, the radial forces and associated orbiting path will be affected by the weight of the various components and the rotational speed at which a failure can be expected. Once the expected radial forces and movement are known the requirements from the various supporting components and necessary movement can be calculated using techniques known in the art.

The predetermined load ranges for each of the support structures needs to be calculated to allow for the distinct failure mechanisms to work in concert so as to provide the staged collapse. Thus, the first load range covers the expected threshold of loading which is required to provide the necessary movement in the slip joint. In doing so, a calculation is made as to the expected force which is required to overcome the frictional engagement and pin location of the slip joint. In the described embodiment, the initial failure of the first fused connection 270 which is attributable to the slip, is achieved at between 20 and 100 kN. The failure of the second fused joint 260, is between 800 kN and 1.2 MN but may be narrower and further removed from the other predetermined ranges. For example, the second range may be between 900 kN and 1.1 MN. The total failure of the first joint is within the range 300 kN and 500 kN, but again this may be different depending on the ranges of the other fuses and the expected radial forces for a particular fan. It will be appreciated that the failure of the second fused connection is greater than the total failure of the first fused connection which is potentially counter-intuitive. This is because the failure of the second fused connection allows the fan assmebly and shaft to move slightly which until the slip is exhausted. At this point the radial load will increase further until the first fused connection fully fails.

The present invention allows the staged break down in the radial retention of the low pressure fan shaft so that the new orbital off-centre rotational path of the low pressure shaft 210 can be accommodated in a controlled way. Additionally, the staged break-down of the support structure allows the energy associated with the unbalancing of the fan to be partially absorbed in a cascade of purposive mechanical failures.

It will be appreciated that the fused connection 270 may be placed elsewhere along the load path. Thus, the fused connection may have been placed at the union between the third segment and supporting wall 242*a*, or elsewhere.

The above described embodiments are provided as examples only and should not be taken as limitations of the broader inventive concept as defined by the spirit or scope of the appended claims.

The invention claimed is:

1. A shaft support system for a gas turbine engine comprising:

a rotatable fan shaft;

first and second support structures extending in parallel from the shaft to a load bearing structure to provide radial location of the shaft within an engine casing, wherein the first support and second support structures include first and second respective mechanical fusible joints;

wherein the first fusible joint is a two-stage fuse which partially fails within a first predetermined load range, the second fusible joint fails within a second predetermined load range which is different to the first load range, and the first fusible joint fully fails only when the second fusible joint has failed; and wherein the first support structure is a bearing chamber wall, and the second support structure is a bearing arrangement within a bearing chamber defined by the bearing chamber wall.

2. A shaft support system as claimed in claim 1, wherein first fusible joint fully fails under a third predetermined load range which is less than the second predetermined load range.

3. A shaft support system as claimed in claim 1, wherein the first fusible joint includes a slip joint and wherein the first load range causes the slip joint to slip.

4. A shaft support system as claimed in claim 3, wherein the first support structure includes first and second members compressibly connected by the slip joint.

5. A shaft support system as claimed in claim 3, wherein the slip joint includes a fastener to provide the compressible connection, and the fastener passes through an aperture in the first member for attachment to the second member, the aperture being over-sized in relation to the fastener such that the fastener will move within the aperture when a load threshold within the first predetermined load range is exceeded.

6. A shaft support system as claimed in claim 1 wherein a bearing arrangement is connected to the shaft, and the second fusible joint is located between the bearing arrangement and the shaft.

7. A shaft support system as claimed in claim 1 wherein the second fusible joint includes a male and female connection having a male part mateably received within a female part.

8. A shaft support system as claimed any claim 7, wherein the female part includes an annular recess in an end surface thereof, the recess being provided by a lip on the radial outer surface of the annular recess, the annular recess receiving and radially restricting the movement of the male part.

9. A shaft support system as claimed in claim 8, further comprising a catcher ring which is axial spaced aft of the bearing arrangement, wherein the lip extends axially, the axial extent of the lip being shorter than the separation between a catcher ring and bearing arrangement.

10. A shaft support system as claimed in claim 1 wherein a bearing chamber wall extends in a radial and axial direction with the first fusible joint being provided along the length of the bearing chamber wall to define radially inner and outer bearing chamber walls which radially overlap when the first fusable link severs.

11. A shaft support system as claimed in claim 1 wherein the shaft and a radially inner surface of an inner race are separated by a radial gap when the shaft is rotatably held on the principal axis of rotation, and wherein once the first and second fusible joints have severed, the shaft orbits within the gap and around the principal axis of rotation on the radially inner surface of the inner race.

12. A support system as claimed in claim 1, wherein the clearance of the aperture in the first fused connection is between 1.2 to 2 times the width of a bolt which holds the first fused connection together.

13. A support system as claimed in claim 1, wherein either or both of the first load range is between 20 and 90 kN and the second load range is between 800 kN and 1.2 MN.

14. A support system as claimed in claim 2, wherein the third predetermined range is between 300 kN and 500 kN.

15. A gas turbine engine comprising the support structure of any preceding claim.

16. A shaft support system for a gas turbine engine comprising:

a rotatable fan shaft;

first and second support structures extending in parallel from the shaft to a load bearing structure to provide radial location of the shaft within an engine casing, wherein the first support and second support structures include first and second respective mechanical fusible joints;

wherein the first fusible joint is a two-stage fuse which partially fails within a first predetermined load range, the second fusible joint fails within a second predetermined load range which is different to the first load range, and the first fusible joint fully fails only when the second fusible joint has failed, wherein the first fusible joint fully fails under a third predetermined load range.

17. A shaft support system as claimed in claim 16, wherein the third predetermined load range is less than the second predetermined load range.

18. A shaft support system as claimed in claim 16, wherein the first fusible joint includes a slip joint and wherein the first load range causes the slip joint to slip.

19. A shaft support system as claimed in claim 18, wherein the slip joint includes a fastener to provide the compressible connection, and the fastener passes through an aperture in the first member for attachment to the second member, the aperture being over-sized in relation to the fastener such that the fastener will move within the aperture when a load threshold within the first predetermined load range is exceeded.

20. A shaft support system as claimed in claim 16 wherein a bearing chamber wall extends in a radial and axial direction with the first fusible joint being provided along the length of the bearing chamber wall to define radially inner and outer bearing chamber walls which radially overlap when the first fusable link severs.

* * * * *